US011412779B2

(12) United States Patent
Bryner

(10) Patent No.: US 11,412,779 B2
(45) Date of Patent: Aug. 16, 2022

(54) SMOKING PIPE CLEANING ASSEMBLY

(71) Applicant: David Bryner, Boonsboro, MD (US)

(72) Inventor: David Bryner, Boonsboro, MD (US)

( * ) Notice: Subject to any disclaimer, the term of this patent is extended or adjusted under 35 U.S.C. 154(b) by 214 days.

(21) Appl. No.: 16/917,064

(22) Filed: Jun. 30, 2020

(65) Prior Publication Data

US 2021/0401035 A1 Dec. 30, 2021

(51) Int. Cl.
*A24F 9/04* (2006.01)
*B08B 3/04* (2006.01)

(52) U.S. Cl.
CPC . *A24F 9/04* (2013.01); *B08B 3/04* (2013.01)

(58) Field of Classification Search
None
See application file for complete search history.

(56) References Cited

U.S. PATENT DOCUMENTS 5,163,459 A * 11/1992 Bailey ..... B44D 3/006 134/182
5,209,248 A 5/1993 Slade, Jr.
6,284,056 B1 9/2001 Gonzalez
8,479,746 B1 7/2013 Tannous
8,584,842 B2 11/2013 Fakhouri
10,010,914 B1 7/2018 Gilmore
D850,030 S 5/2019 Tian
2007/0163608 A1 7/2007 Tarlow
2011/0068026 A1* 3/2011 Fakhouri ..... A24F 9/04 29/700
2012/0118333 A1* 5/2012 Piccioni ..... A46B 17/06 134/33
2016/0279680 A1 9/2016 Lutz
2018/0078663 A1* 3/2018 Voss ..... A61L 2/025

* cited by examiner

*Primary Examiner* — Mikhail Kornakov
*Assistant Examiner* — Ryan L Coleman

(57) ABSTRACT

A smoking pipe cleaning assembly for cleaning a smoking pipe includes a cylinder that is hollow to contain a fluid cleaning solution. A smoking pipe is insertable into the cylinder to submerge the smoking pipe in the fluid cleaning solution for cleaning the smoking pipe. A first cap is removably attachable to the cylinder and the first cap engages the smoking pipe to inhibit the smoking pipe from striking the cylinder. A second cap is removably attachable to the cylinder and the second cap receives the smoking pipe to inhibit the smoking pipe from striking the second cap. A base for is provided that insertably receives the cylinder when the smoking pipe is positioned in the cylinder.

8 Claims, 5 Drawing Sheets

SMOKING PIPE CLEANING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to pipe cleaning devices and more particularly pertains to a new pipe cleaning device for soaking a smoking pipe in a cleaning solution.

(2) Description of Related Art Including Information Disclosed Under 37 CFR 1.97 and 1.98

The prior art relates to pipe cleaning devices including a battery powered pipe cleaner that includes a spring that is rotated in a bowl of a smoking pipe for cleaning the smoking pipe. The prior art discloses a method of producing a fluid cleaning solution for dissolving resin in a smoking pipe to clean the smoking pipe. The prior art discloses a vacuum unit that can be fluidly coupled to a hookah to force air through the hookah for smoking material in the hookah. The prior art discloses a cylindrical smoking material storage device for storing smoking material and a smoking pipe. The prior art further discloses a self cleaning water pipe that continuously deposits water on an inner surface of a smoking pipe to inhibit particles of combustion from collecting on the inner surface. The prior art discloses a smoking pipe storage device that is shaped like an ink pen for discretely storing the smoking pipe.

BRIEF SUMMARY OF THE INVENTION

An embodiment of the disclosure meets the needs presented above by generally comprising a cylinder that is hollow to contain a fluid cleaning solution. A smoking pipe is insertable into the cylinder to submerge the smoking pipe in the fluid cleaning solution for cleaning the smoking pipe. A first cap is removably attachable to the cylinder and the first cap engages the smoking pipe to inhibit the smoking pipe from striking the cylinder. A second cap is removably attachable to the cylinder and the second cap receives the smoking pipe to inhibit the smoking pipe from striking the second cap. A base for is provided that insertably receives the cylinder when the smoking pipe is positioned in the cylinder.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
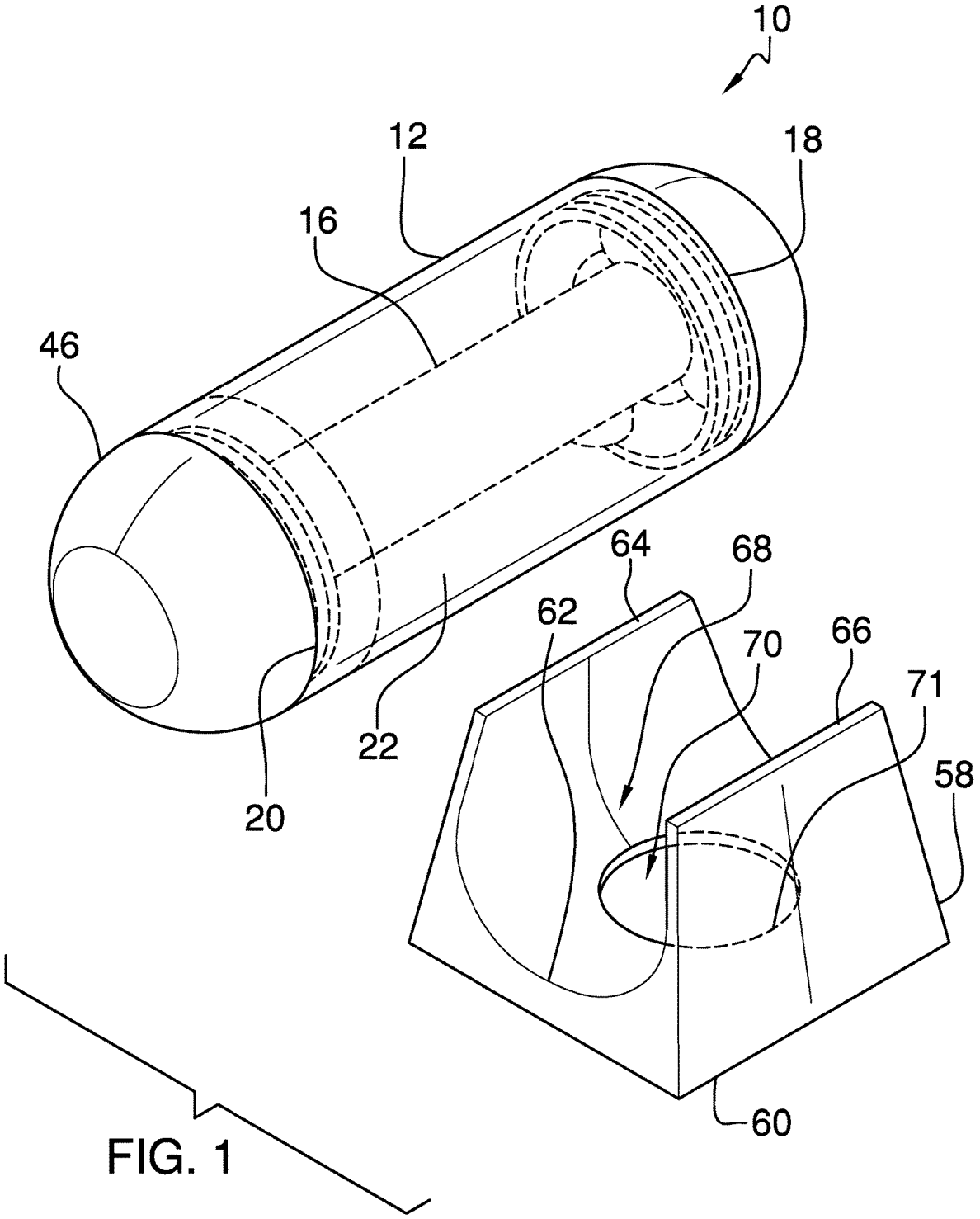
FIG. 1 is a perspective phantom view of a smoking pipe cleaning assembly according to an embodiment of the disclosure.
Figure 2:
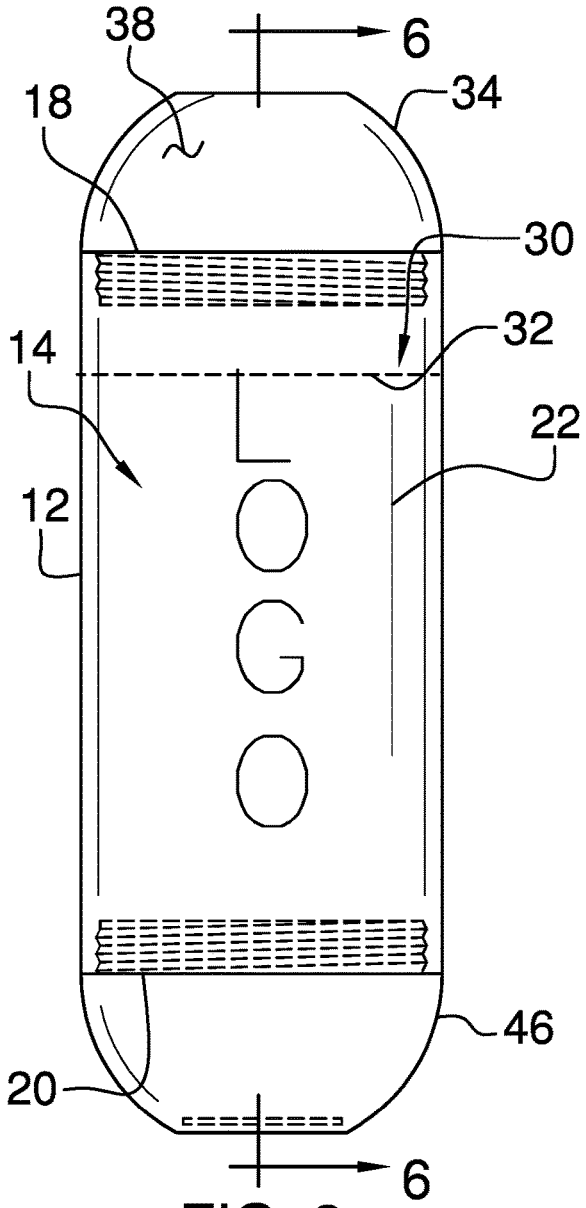
FIG. 2 is a front phantom view of an embodiment of the disclosure.
Figure 3:
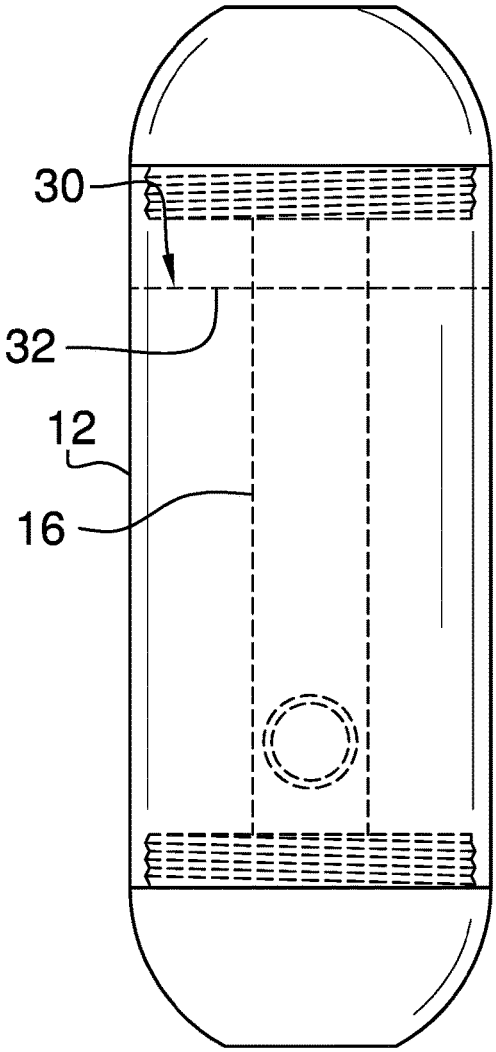
FIG. 3 is a back phantom view of an embodiment of the disclosure.
Figure 4:
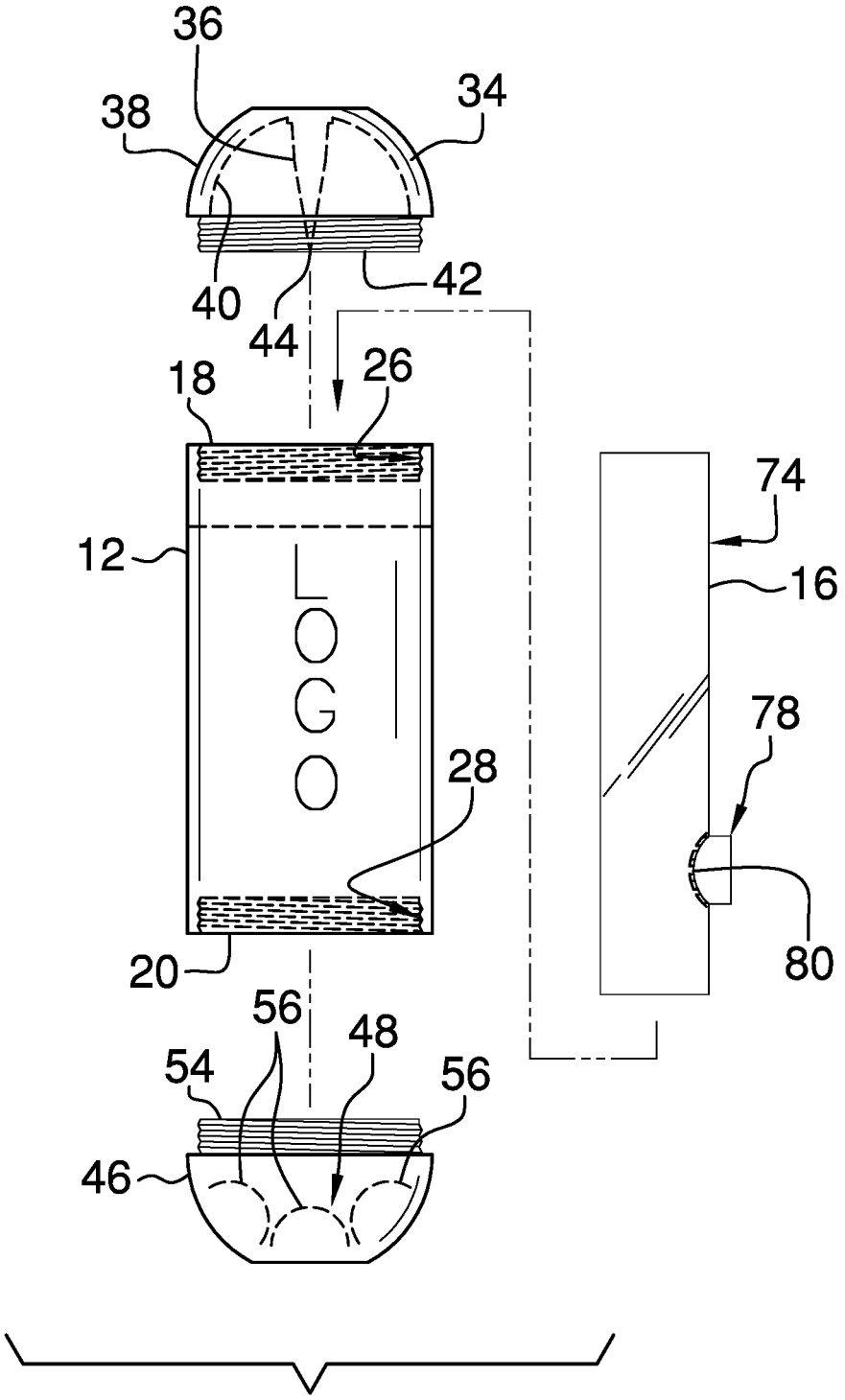
FIG. 4 is an exploded phantom view of an embodiment of the disclosure.
Figure 5:
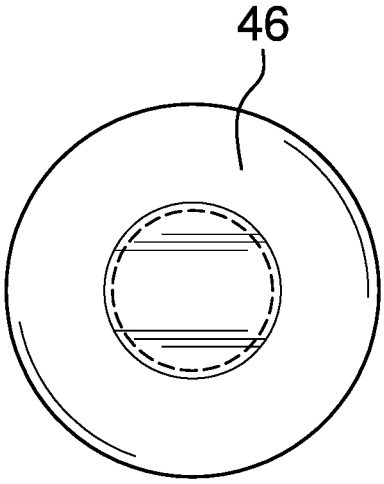
FIG. 5 is a top phantom view of an embodiment of the disclosure.
Figure 6:
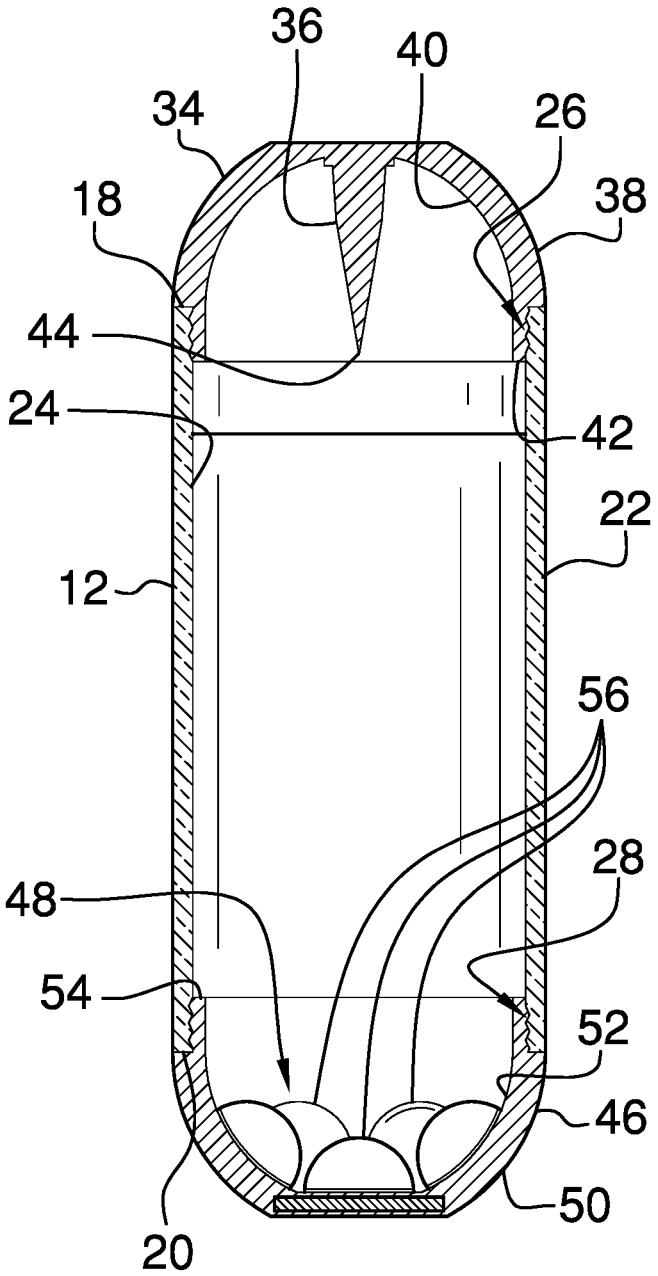
FIG. 6 is a cross sectional view taken along line 6-6 of FIG. 2 of an embodiment of the disclosure.

With reference now to the drawings, and in particular to FIGS. 1 through 7 thereof, a new pipe cleaning device embodying the principles and concepts of an embodiment of the disclosure and generally designated by the reference numeral 10 will be described.

As best illustrated in FIGS. 1 through 7, the smoking pipe cleaning assembly 10 generally comprises a cylinder 12 that is hollow to contain a fluid cleaning solution 14. The fluid cleaning solution 14 may be any fluid cleaner that is employed for cleaning resin from a medical marijuana smoking pipe. The cylinder 12 is longitudinally elongated for accommodating a smoking pipe 16. Moreover, the cylinder 12 facilitates the smoking pipe 16 to be submerged in the fluid cleaning solution 14 for cleaning the smoking pipe 16.

The cylinder 12 has a first end 18, a second end 20 and an outer wall 22 extending therebetween, and each of the first end 18 and the second end 20 is open into an interior of the cylinder 12. The outer wall 22 has an interior surface 24, the interior surface 24 has a first threaded portion 26 adjacent to the first end 18 and the interior surface 24 has a second threaded portion 28 adjacent to the second end 20. The outer wall 22 may be comprised of an opaque material of a black color. Additionally, the interior surface 24 of the outer wall 22 has fill indicia 30 printed thereon comprising a fill line 32 extending around a full circumference of the inner surface 24. The fill line 32 indicates a maximum fill amount of the fluid cleaning solution 14 and the fill line 32 is spaced from the first end 18.

A first cap 34 is provided and the first cap 34 is removably attachable to the cylinder 12. The first cap 34 has an engagement 36 integrated therein. The engagement 36 extends into the cylinder 12 and engages the smoking pipe 16 when the first cap 34 is coupled to the cylinder 12 and the smoking pipe 16 is positioned in the cylinder 12. In this way the engagement 36 inhibits the smoking pipe 16 from bouncing against the outer wall 22 of the cylinder 12.

The first cap 34 has an outer surface 38, an inner surface 40 and a lower edge 42 extending therebetween. The inner surface 40 is concavely arcuate with respect to the lower edge 42 such that the first cap 34 has a cup shape and the outer surface 38 is co-arcuate with the inner surface 40. The outer surface 38 is flattened at an apex of the first cap 34 and the outer surface 38 is threaded adjacent to the lower edge 42. The engagement 36 is coupled to the inner surface 40 and extends toward the lower edge 42, and the engagement 36 is centrally positioned in the first cap 34. Moreover, the engagement 36 tapers to a point between the inner surface 40 and a distal end 44 of the engagement 36 such that the engagement 36 extends into the smoking pipe 16. In this way the smoking pipe 16 can slide upwardly and downwardly on the engagement 36 to create an agitating motion to enhance cleaning the smoking pipe 16. The outer surface 38 threadably engages the first threaded portion 26 of the interior surface 24 of the cylinder 12 for closing the first end 18 of the cylinder 12.

A second cap 46 is provided and the second cap 46 is removably attachable to the cylinder 12. The second cap 46 has a restraint 48 therein for receiving the smoking pipe 16 when the smoking pipe 16 is inserted into the cylinder 12 to inhibit the smoking pipe 16 from striking the second cap 46. The second cap 46 has an outside surface 50, an inside surface 52 and a top edge 54 extending therebetween. The inside surface 52 is concavely arcuate with respect to the top edge 54 such that the second cap 46 has a cup shape and the outside surface 50 is co-arcuate with the inside surface 52. The outside surface 50 is flattened at an apex of the second cap 46 and the outside surface 50 threaded adjacent to the top edge 54.

The restraint 48 comprises a plurality of lobes 56 each extending upwardly from the inside surface 52. The lobes 56 are spaced apart from each other and are distributed around a point that is aligned with the apex of the second cap 46. In this way the smoking pipe 16 can centrally positioned in the plurality of lobes 56 such that the smoking pipe 16 is oriented to extend along an axis extending through the apex of the first cap 34 and the apex of the second cap 46. Each of the lobes 56 may be comprised of a resiliently compressible material to inhibit the smoking pipe 16 from being damaged from impacting the lobes 56. The outside surface 50 threadably engages the second threaded portion 28 of the interior surface 24 of the cylinder 12 for closing the second end 20.

A base 58 is provided for insertably receiving the cylinder 12 when the smoking pipe 16 is positioned in the cylinder 12. The base 58 has a bottom side 60 and a top side 62, and the top side 62 is concavely arcuate between a first lateral side 64 and a second lateral side 66 of the base 58 to define a trough 68 for receiving the cylinder 12. The outer wall 22 of the cylinder 12 lies in the trough 68 when the cylinder 12 is stored in the base 58. Additionally, the top side 60 a recess 70 extending toward the bottom side 60, and the recess 70 is centrally positioned on the trough 68. The recess 70 insertably receives the second cap 46 thereby facilitating the cylinder 12 to be vertically oriented in the base 58. A magnet 71 is positioned in the recess 70, and the second cap 46 is comprised of a magnetic material. In this way the magnet 71 magnetically engages the second cap 46 for retaining the cylinder 12 in the vertical orientation.

Figure 7:
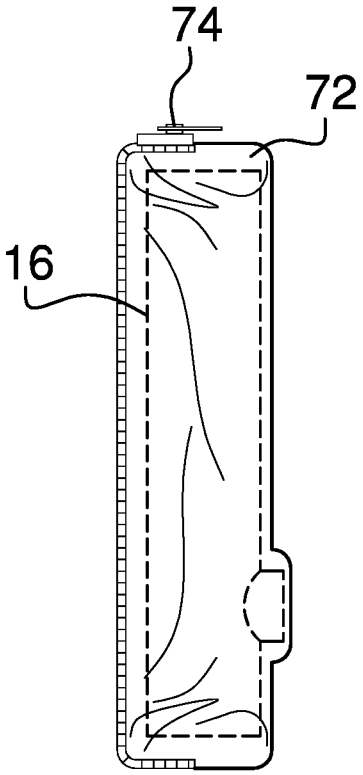
FIG. 7 is a phantom view of a storage bag and a smoking pipe of an embodiment of the disclosure.

As is most clearly shown in FIG. 7, a storage bag 72 may be provided and the storage bag 72 may be comprised of a fluid impermeable material thereby inhibiting odors associated with the smoking pipe 16 from escaping the storage bag 72. A closure 74, such as a zipper or other similar closure, is coupled to the storage bag 72 for opening and closing the storage bag 72. The smoking pipe 16 may comprise an elongated first portion 76 and a second portion 78 oriented perpendicular to the first portion 76. The second portion 78 may be in fluid communication with the first portion 76, and the second portion 78 may receive smoking material for smoking. The smoking pipe 16 may be comprised of a rigid material, such as borosilicate or the like, and the fluid cleaning solution 14 may be a cleaning solution that is approved for cleaning the material of which the smoking pipe 16 is comprised. As is most clearly shown in FIG. 4, the second portion 78 may be separated from the first portion 76 with a perforated barrier 80 for passing smoke into the first portion 76.

In use, the second cap 46 is attached to the cylinder 12, the first cap 34 is removed from the cylinder 12 and the cylinder 12 is filled to the fill line 32 with the fluid cleaning solution 14. The smoking pipe 16 is inserted into the cylinder 12 until an end of the smoking pipe 16 is positioned between the lobes 56 on the second cap 46. The first cap 34 is installed on the cylinder 12 such that the engagement 36 extends into the smoking pipe 16. In this way the smoking pipe 16 is retained in the middle of the cylinder 12 while the fluid cleaning solution 14 cleans the smoking pipe 16. The cylinder 12 is stood upright in the recess in the base 58 while the smoking pipe 16 is soaking in the fluid cleaning solution 14. The smoking pipe 16 is removed from the cylinder 12 when sufficient time has passed for the fluid cleaning solution 14 to clean resin from the smoking pipe 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A smoking pipe cleaning assembly for containing a cleaning solution and a smoking pipe for cleaning the smoking pipe, said assembly comprising:

a cylinder being hollow wherein said cylinder is configured to contain a fluid cleaning solution, said cylinder being longitudinally elongated for accommodating a smoking pipe wherein said cylinder is configured to submerge the smoking pipe in the fluid cleaning solution for cleaning the smoking pipe;

a first cap being removably attachable to said cylinder, said first cap having an engagement being integrated therein, said engagement extending into said cylinder and engaging the smoking pipe when said first cap is coupled to said cylinder and the smoking pipe is positioned in said cylinder wherein said engagement is configured to inhibit the smoking pipe from striking the cylinder;

a second cap being removably attachable to said cylinder, said second cap having a restraint therein for receiving the smoking pipe when said smoking pipe is inserted into said cylinder for inhibiting the smoking pipe from striking the second cap;

a base for insertably receiving said cylinder when the smoking pipe is positioned in said cylinder;

wherein said second cap has an outside surface, an inside surface and a top edge extending therebetween, said inside surface being concavely arcuate with respect to said top edge such that said second cap has a cup shape, said outside surface being co-arcuate with said inside surface, said outside surface being flattened at an apex of said second cap, said outside surface threaded adjacent to said top edge; and wherein said restraint comprises a plurality of lobes each extending upwardly from said inside surface, each of said lobes being spaced apart from each other and being distributed around a point being aligned with said apex of said second cap thereby facilitating the smoking pipe to be centrally positioned in said plurality of lobes such that the smoking pipe is oriented to extend along an axis extending through an apex of said first cap and said apex of said second cap.

2. The assembly according to claim 1, wherein said cylinder has a first end, a second end and an outer wall extending therebetween, each of said first end and said second end being open into an interior of said cylinder, said outer wall having an interior surface, said interior surface having a first threaded portion adjacent to said first end, said interior surface having a second threaded portion adjacent to said second end.

3. The assembly according to claim 2, wherein said outer wall is comprised of an opaque material, said interior surface of said outer wall having fill indicia printed thereon comprising a line extending around a full circumference of said outer wall wherein said fill indicia is configured to indicate a maximum fill amount of the fluid cleaning solution, said fill line being spaced from said first end.

4. The assembly according to claim 1, wherein said first cap has an outer surface, an inner surface and a lower edge extending therebetween, said inner surface being concavely arcuate with respect to said lower edge such that said first cap has a cup shape, said outer surface being co-arcuate with said inner surface, said outer surface being flattened at said apex of said first cap, said outer surface being threaded adjacent to said lower edge.

5. The assembly according to claim 4, wherein said engagement is coupled to said inner surface and extends toward said lower edge, said engagement being centrally positioned in said first cap, said engagement tapering to a point between said inner surface and a distal end of said engagement such that said engagement extends into the smoking pipe.

6. The assembly according to claim 1, wherein said base has a bottom side and a top side, said top side being concavely arcuate between a first lateral side and a second lateral side of said base to define a trough for receiving said cylinder having said outer wall of said cylinder lying in said trough.

7. The assembly according to claim 6, wherein said top side of said base has a recess extending toward said bottom side, said recess being centrally positioned on said trough, said recess insertably receiving said second cap thereby facilitating said cylinder to be vertically oriented in said base.

8. A smoking pipe cleaning assembly for containing a cleaning solution and a smoking pipe for cleaning the smoking pipe, said assembly comprising:

a cylinder being hollow wherein said cylinder is configured to contain a fluid cleaning solution, said cylinder being longitudinally elongated for accommodating a smoking pipe wherein said cylinder is configured to submerge the smoking pipe in the fluid cleaning solution for cleaning the smoking pipe, said cylinder having a first end, a second end and an outer wall extending therebetween, each of said first end and said second end being open into an interior of said cylinder, said outer wall having an interior surface, said interior surface having a first threaded portion adjacent to said first end, said interior surface having a second threaded portion adjacent to said second end, said outer wall being comprised of an opaque material wherein, said outer wall having fill indicia printed thereon comprising a line extending around a full circumference of said outer wall wherein said fill indicia is configured to indicate a maximum fill amount of the fluid cleaning solution, said fill line being spaced from said first end;

a first cap being removably attachable to said cylinder, said first cap having an engagement being integrated therein, said engagement extending into said cylinder and engaging the smoking pipe when said first cap is coupled to said cylinder and the smoking pipe is positioned in said cylinder wherein said engagement is configured to inhibit the smoking pipe from striking the cylinder, said first cap having an outer surface, an inner surface and a lower edge extending therebetween, said inner surface being concavely arcuate with respect to said lower edge such that said first cap has a cup shape, said outer surface being co-arcuate with said inner surface, said outer surface being flattened at an apex of said first cap, said outer surface being threaded adjacent to said lower edge, said engagement being coupled to said inner surface and extending toward said lower edge, said engagement being centrally positioned in said first cap, said engagement tapering to a point between said inner surface and a distal end of said engagement such that said engagement extends into the smoking pipe, said outer surface threadably engaging said first threaded portion of said interior surface of said cylinder for closing said first end of said cylinder;

a second cap being removably attachable to said cylinder, said second cap having a restraint therein for receiving the smoking pipe when said smoking pipe is inserted into said cylinder for inhibiting the smoking pipe from striking the second cap, said second cap having an outside surface, an inside surface and a top edge extending therebetween, said inside surface being concavely arcuate with respect to said top edge such that said second cap has a cup shape, said outside surface being co-arcuate with said inside surface, said outside surface being flattened at an apex of said second cap, said outside surface threaded adjacent to said top edge, said restraint comprising a plurality of lobes each extending upwardly from said inside surface, each of said lobes being spaced apart from each other and being distributed around a point being aligned with said apex of said second cap thereby facilitating the smoking pipe to be centrally positioned in said plurality of lobes such that the smoking pipe is oriented to extend along an axis extending through said apex of said first cap and said apex of said second cap, said outside surface threadably engaging said second threaded portion of said interior surface of the cylinder for closing said second end; and a base for insertably receiving said cylinder when the smoking pipe is positioned in said cylinder, said base having a bottom side and a top side, said top side being concavely arcuate between a first lateral side and a second lateral side of said base to define a trough for receiving said cylinder having said outer wall of said cylinder lying in said trough, said top side having an recess extending toward said bottom side, said recess being centrally positioned on said trough, said recess insertably receiving said second cap thereby facilitating said cylinder to be vertically oriented in said base.

* * * * *